United States Patent [19]

Scheel

[11] 4,086,854

[45] May 2, 1978

[54] VEHICLE CONTROL DEVICE

[75] Inventor: Russell H. Scheel, Easton, Pa.

[73] Assignee: SI Handling Systems, Inc., Easton, Pa.

[21] Appl. No.: 731,868

[22] Filed: Oct. 13, 1976

[51] Int. Cl.[2] ..... B61B 13/12

[52] U.S. Cl. ..... 104/166; 104/252

[58] Field of Search ..... 104/165, 166, 167, 168, 104/245, 246, 247; 74/569, 190; 105/241 C, 268

[56] References Cited

U.S. PATENT DOCUMENTS

| | | | |
|---|---|---|---|
| 1,122,396 | 12/1914 | Jackson | 104/247 |
| 1,266,630 | 5/1918 | Ross et al. | 105/241 C |
| 1,448,763 | 3/1923 | Miller | 104/246 |
| 3,897,735 | 8/1975 | Watts | 104/166 |
| 3,903,810 | 9/1975 | Jones | 104/252 |
| 4,036,148 | 7/1977 | Jones et al. | 104/166 |

FOREIGN PATENT DOCUMENTS

| | | | |
|---|---|---|---|
| 1,171,130 | 4/1957 | France | 104/246 |

*Primary Examiner*—Drayton E. Hoffman
*Assistant Examiner*—Carl Rowold
*Attorney, Agent, or Firm*—Seidel, Gonda & Goldhammer

[57] ABSTRACT

A control device is provided for controlling the speed of a vehicle used in a conveyor system wherein the vehicle moves along a track. The control device has a generally straight section between a first angled section having a cam surface for deceleration and a second angled section having a cam surface for acceleration in a controlled manner. The control member is supported for movement between operative and inoperative positions. A motor is provided for moving the control member from an inoperative position to an operative position. The control member is held in its operative position by a cam follower on the vehicle. When the cam follower loses contact with the control member, the control member moves to its inoperative position by gravity.

7 Claims, 4 Drawing Figures

VEHICLE CONTROL DEVICE

BACKGROUND

This invention is an improvement over U.S. Pat. No. 3,903,810. Vehicles of the general type involved herein are known. For example, see U.S. Pat. No. 3,356,040. As disclosed in said patents, a vehicle is guided for movement along the track and has a speed control wheel angularly adjustable with respect to a longitudinally extending drive shaft. The relative rotative position of said wheel with respect to said drive shaft controls the speed of movement of the vehicle along the tracks.

In U.S. Pat. No. 3,903,810, the control member is supported by a spring biased latch when disposed in its operative position. This invention simplifies the number of components involved by eliminating the latch and causes the function of the latch to be performed by the cam follower on the vehicle.

SUMMARY OF THE INVENTION

The vehicle control device of the present invention includes a speed control member having a generally straight section disposed between a first angled section having a cam surface for controlling decleration and a second angled section having a cam surface for controlling acceleration. The straight section is adapted to maintain a cam follower in a position wherein the vehicle is stopped or permitted to move forward very slowly. A motor means is provided for selectively moving the control member from an inoperative position to an operative position.

The vehicle control device of the present invention is adapted to be installed between one of the tracks which guide the vehicle and the main drive shaft. The control member is biased to an inoperative position by gravity. Hence, all vehicles will pass over the control member without being stopped unless the motor means is selectively operated to move the control member to an operative position. The cam follower on the vehicle performs the additional function of holding up the control member so that it will automatically drop to an inoperative position after the vehicle has passed the control member.

It is an object of the present invention to provide a novel vehicle control device which is gravity biased to an inoperative position.

It is another object of the present invention to provide a vehicle control device for cooperation with a cam follower on a vehicle whereby the cam follower temporarily supports the control member in an operative position and enables the control member to move to an inoperative position after the cam follower loses contact with the control member.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown a conveyor system designated generally as 10 and incorporating the vehicle control device of the present invention designated generally as 12.

A vehicle designated generally as 14 is provided with wheels in rolling contact with tracks not shown. A drive shaft 18 is provided between the tracks and is parallel thereto. A drive wheel 20 is supported by the vehicle 14 and is in rolling contact with the drive shaft 18. The velocity of the vehicle 14 depends upon the angular disposition of the drive wheel 20 with respect to the longitudinal axis of the drive shaft 18. The drive shaft 18 rotates about its longitudinal axis and may be comprised of a plurality of axially interconnected sections.

Figure 1:
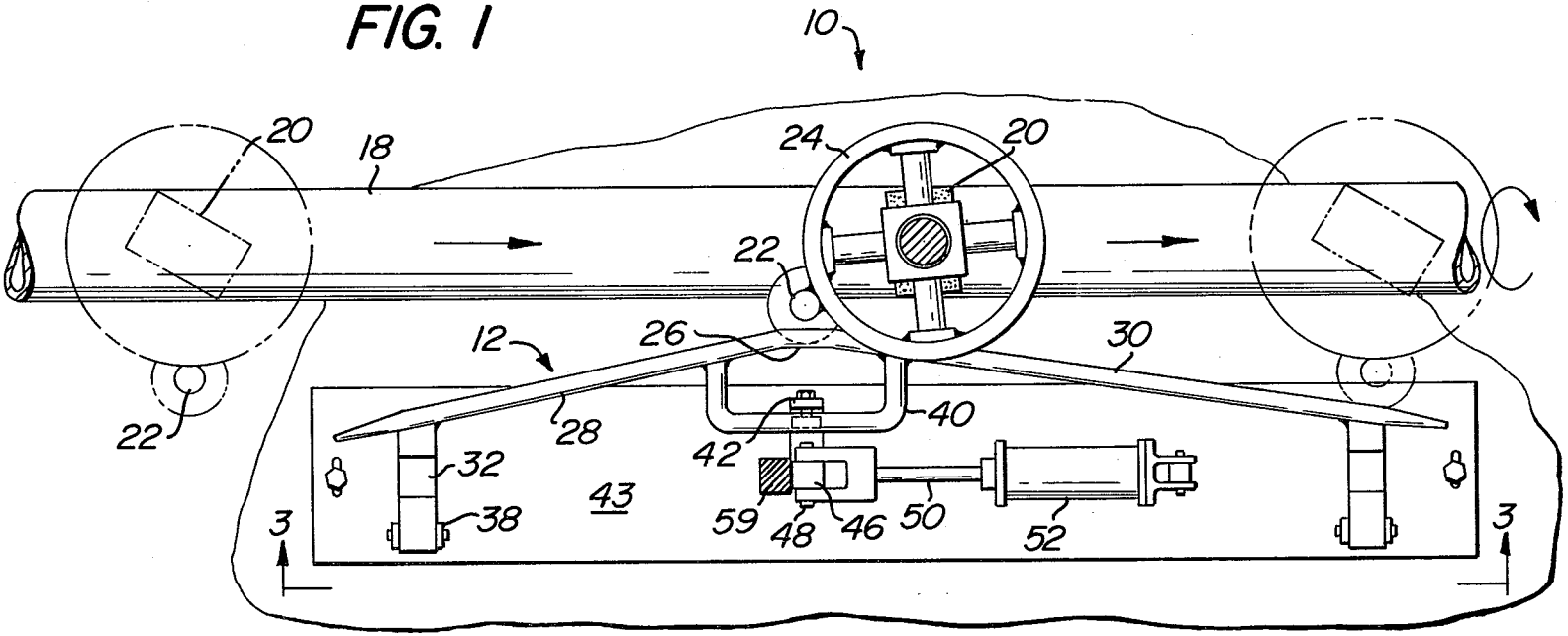
FIG. 1 is a partial plan view of a conveyor system incorporating the control device of the present invention.

An arm 24 is rotatably supported by vehicle 14 and interconnected with a housing supporting the wheel 20. The housing for wheel 20 and arm 24 is preferably biased in any convenient manner, such as by a torsion spring, wherein the drive wheel 20 rotates about an axis which is approximately 45° with respect to the longitudinal axis of drive shaft. See the phantom position of wheel 20 as shown at the left in FIG. 1. In this position, the vehicle 14 is moving at its maximum velocity. When the axis of rotation of the drive wheel 20 is parallel to the longitudinal axis of drive shaft 18, the velocity of the vehicle 14 is zero.

Figure 2:
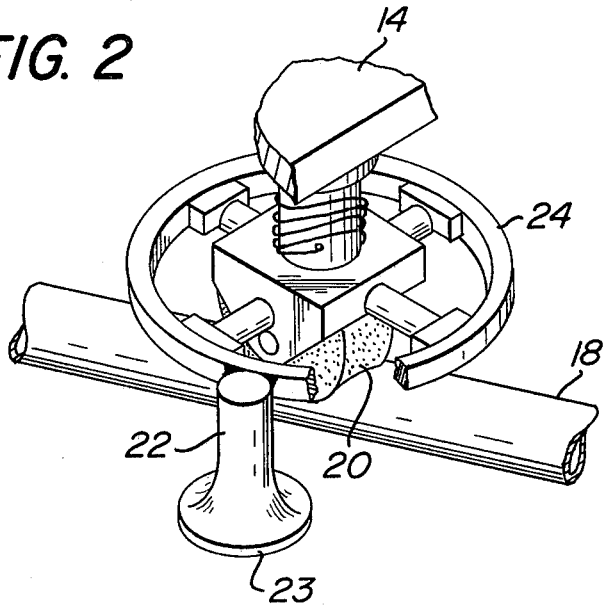
FIG. 2 is a partial isometric view of a vehicle having a drive wheel and an associated cam follower for controlling the position of the wheel with respect to a drive shaft.

The arm 24 rotatably supports a cam follower 22. The normal position of follower 22, when vehicle 14 is moving at uniform speed, is shown in phantom at the left-hand end of FIG. 1. As shown more clearly in FIGS. 2 and 4, the cam follower 22 is circular in cross section and has a projection 23. The purpose of projection 23 will be made clear hereinafter. Cam follower 22 is preferably concave with a relatively large radius of curvature.

The control device 12 may be located at a variety of positions between the tracks for adjustment toward and away from the drive shaft 18. The control device 12 is located where it is desired to cause a vehicle to slow down and/or stop. The purpose of stopping the vehicle may include a variety of functions such as loading the vehicle, unloading the vehicle, performing a manipulative step with respect to material or devices supported by the vehicle, etc.

The control device 12 includes a rigid control member having a straight section 26 between a first angled section 28 and a second angled section 30. The angled sections 28 and 30 are longer than the straight section 26 in the preferred embodiment and converge toward straight section 26. Also, it is preferred to have the section 30 longer than section 28. The sections 26–30 lie in a generally horizontal plane in their operative position. The sections 26–30 are preferably made of bar stock so as to be circular in cross section and lie in a plane in their operative position which is slightly above the elevation of the drive shaft 18. The first angled section 28 is a cam surface for controlling deceleration of the vehicle 14 while the second angled section 30 is a cam surface for controlling acceleration of the vehicle 14.

The control member 12 is supported at its ends by brackets 32, 34. The brackets 32 and 34 pivotably support control member 12 for pivotable movement about a horizontally disposed axis. The free ends of the brackets 32 and 34 are pivotably connected to the upper end of standards 38, 39 on base plate 43. A U-shaped yoke 40 extends from the angled sections 28 and 30.

A stop bar 42 is provided on its upper end with a rotatable follower 44. Follower 44 is located so that it may contact the yoke 40 and elevate the same when desired. The lower end of stop bar 42 is fixedly connected to a horizontally disposed rotatable pin 48. A second stop bar 46 is fixedly secured at its lower end to said pin 48 for simultaneous movement with stop bar 42. Stop bar 46 is longer than stop bar 42. See FIG. 4.

Stop bar 46 is pivotably connected to one end of a clevis. The other end of the clevis is connected to a piston rod 50. The piston rod 50 is connected to a piston within cylinder 52. Cylinder 52 is pivotably supported by the base plate 43 for pivotable movement about a horizontal axis. The cylinder 52 constitutes a motor means. Other equivalent devices which are selectively operable and can form the function of cylinder 52 may be utilized such as a solenoid, electric motor, etc.

Figure 3:
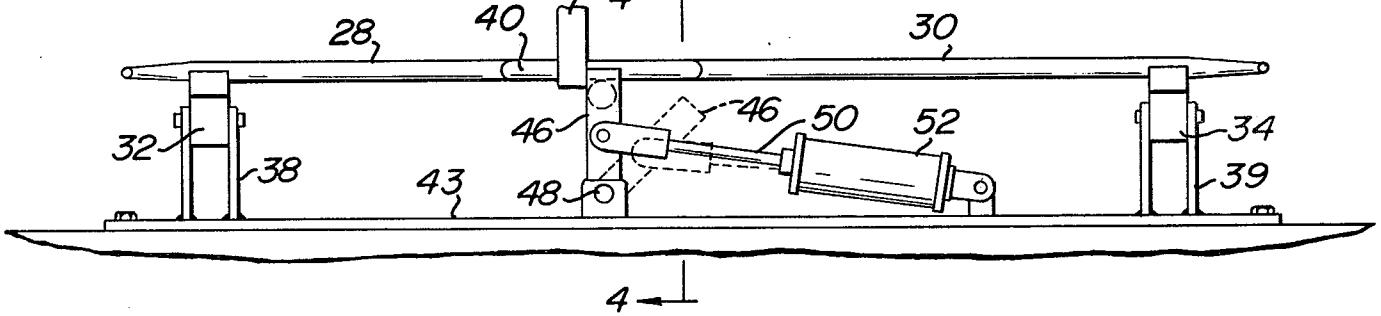
FIG. 3 is a side elevation view as seen along the line 3—3 in FIG. 1.
Figure 4:
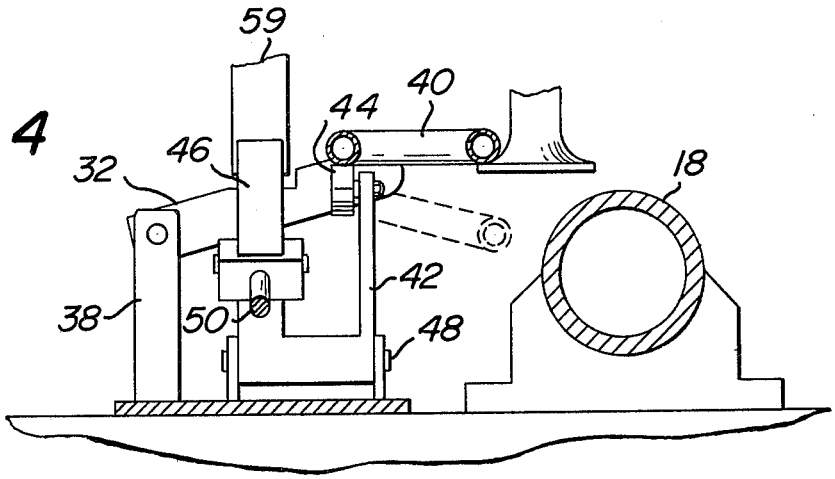
FIG. 4 is an end view as seen from the right to left in FIG. 1.

When the piston rod 50 is retracted, stop bars 42 and 46 pivot to their inoperative position as shown in phantom in FIG. 3. Since the cylinder 52, by way of stop bar 42, constitutes the only means for moving the control member 12 to its operative position, the control member 12 is gravity biased to an inoperative phantom position as shown in FIG. 4 whenever the piston rod 50 is retracted. Cylinder 52 is selectively operated in any convenient manner such as by use of a solenoid control valve for controlling the supply and exhaust of motive fluid to the cylinder 52.

The upper end of the stop bar 46 acts as a positive limit stop. A projection 59 on the lower surface of vehicle 14 is arranged so as to contact the upper end of stop bar 46 whenever the cam follower 22 is juxtaposed to the straight section 26. See FIG. 1. Straight section 26 is preferably adjusted so that the wheel 20 rotates about an axis which is approximately 3°–5° with respect to the longitudinal axis of the drive shaft 18. This provides for a slight forward movement or thrust on the vehicle 14 which is counteracted by contact between projection 59 and the upper end of the stop bar 46.

As soon as the cam follower 22 engages the angled section 28, cylinder 52 may be deactivated in any convenient manner such as by microswitch, proximity switch, etc. The control member 12 will remain in its operative disposition since it will be held up by the projection 23 on the cam follower 22. This will cause the vehicle to slow down, almost come to a stop when the cam follower 22 is opposite section 26, and then will accelerate in a controlled manner. As soon as the cam follower 22 loses contact with section 30, the control member 12 will pivot downwardly under the force of gravity to its inoperative position. If it is desired to cause the vehicle 14 to stop for a predetermined period of time, cylinder 52 will not be deactivated until it is desired to release the vehicle. The vehicle will remain stopped due to contact between projection 59 and the upper end of the stop bar 46.

In the preferred embodiment, the acute angle for the disposition of the sections 28 and 30 with respect to the longitudinal axis of the drive shaft 18 predetermines the rate of deceleration and acceleration for the vehicle 14. It is preferred to have section 30 longer than section 28 to provide for uniform acceleration. However, the length of the sections 28 and 30 may be the same. To provide for smooth contact and loss of contact between sections 28 and 30 with respect to the cam follower 22, the ends of the sections 28 and 30 are preferably tapered as shown. The cam follower 22 performs the dual functions of transmitting the camming action for rotating the drive wheel 20 and also performs the function of maintaining the control member 12 in its operative position until after the vehicle has left the area of the control member. As soon as the cam follower 22 loses contact with the section 30, control member 12 will move to its inoperative position. This provides for positive control over the location of member 12 which is not otherwise attainable when a latch must be disconnected to cause control member 12 to move to an inoperative position. Thus, the present invention results in fewer components subject to malfunction whereby the reliability of the system is materially increased.

The present invention may be embodied in other specific forms without departing from the spirit or essential attributes thereof and, accordingly, reference should be made to the appended claims, rather than to the foregoing specification as indicating the scope of the invention.

I claim:

1. In a vehicle control device for use with vehicles adapted to move along a track comprising a speed control member having a generally straight section between a first angled section having a cam surface for controlling deceleration of a vehicle and a second angled section having a cam surface for controlling acceleration of a vehicle, each of said angled sections converging toward and terminating at said straight section, motor means for moving said control member from a lower inoperative position wherein a cam follower on a vehicle cannot contact the sections of said control member to an upper operative position wherein a cam follower on a vehicle can contact the sections of said control member, and said control member being at all times gravity biased downwardly from said operative position to said inoperative position, the improvement comprising providing said cam follower on said vehicle for supporting said control device in said operative position.

2. A control device in accordance with claim 1 wherein said sections of said control member having a round peripheral surface for contact with the periphery of a concave surface on a cam follower.

3. A device in accordance with claim 2 including a vehicle having a drive wheel connected to a cam follower, said cam follower having a projection at its lower end for contacting and supporting the control member in its operative position so long as the cam follower is in contact with one of said sections.

4. A method of controlling vehicle traffic along a track comprising providing a speed control member at a location along the track where it is desired to cause a vehicle to slow down or stop, positioning the control member for pivotable movement about an axis which is horizontally disposed so that the control member will be biased downwardly from an operative position wherein said control member can control the speed of a vehicle to an inoperative position wherein said control member cannot control the speed of a vehicle, providing a means for moving said control member from its inoperative to its operative position, providing the vehicle with a cam follower having a projection thereon and rotatable about a vertical axis with a drive wheel on the vehicle, causing the cam follower projection to support the control member in its operative position so long as the control member and cam follower are in contact with one another and when said moving means provides no support for said control member whereby the control member moves to its inoperative position as a result of lack of contact with said projection if said moving means provides no support for said control member.

5. A method in accordance with claim 4 including using a cam follower having the shape of a truncated cone with a concave peripheral surface projecting upwardly from said projection thereon.

6. Apparatus comprising a vehicle having a drive wheel rotatable about a vertical axis and in contact with a horizontally disposed drive shaft which in turn is rotatable about its longitudinal axis, a follower means connected to said drive wheel and rotatable therewith, a control device for controlling the speed of the vehicle and comprising a speed control member having a generally straight section between a first angled section having a cam surface for controlling deceleration of the vehicle and a second angled section having a cam surface for controlling acceleration of the vehicle, each of said angled sections converging toward and terminating at said straight section, said straight section being generally parallel to said drive shaft, motor means for moving said control member from a lower inoperative position wherein said follower means cannot contact any of said sections to an upper operative position wherein said follower means can contact said sections, and said control member being biased downwardly from said operative position to said inoperative position, said follower means being at an elevation for contact with said control member, said follower means forming a means for supporting said control member in said operative position when said follower means is in contact with said control member and when said motor means provides no support for said control member so that said control member moves to its inoperative position as a result of lack of contact with said follower means if said motor means is providing no support for said control member.

7. Apparatus in accordance with claim 6 wherein said follower means is a round peripheral surface for contact with a side face of said cam surfaces and includes a projection at its lower end for contact with a lower surface of said control member.

* * * * *